US010242651B2

(12) United States Patent
Takashimada

(10) Patent No.: US 10,242,651 B2
(45) Date of Patent: Mar. 26, 2019

(54) DISPLAY APPARATUS INCLUDING DISPLAY UNIT WHICH DISPLAYS IMAGE, DISPLAY METHOD, AND STORAGE MEDIUM

(71) Applicant: CASIO COMPUTER CO., LTD., Shibuya-ku, Tokyo (JP)

(72) Inventor: Yubi Takashimada, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 4 days.

(21) Appl. No.: 15/460,617

(22) Filed: Mar. 16, 2017

(65) Prior Publication Data

US 2017/0372680 A1 Dec. 28, 2017

(30) Foreign Application Priority Data

Jun. 23, 2016 (JP) ..... 2016-124788

(51) Int. Cl.

| | |
|---|---|
| ***G09G 5/26*** | (2006.01) |
| ***G09G 5/34*** | (2006.01) |
| ***G09G 5/30*** | (2006.01) |
| ***G09G 5/377*** | (2006.01) |
| *G09G 3/00* | (2006.01) |

(52) U.S. Cl.

CPC ..... *G09G 5/30* (2013.01); *G09G 5/26* (2013.01); *G09G 5/34* (2013.01); *G09G 5/377* (2013.01); *G09G 3/002* (2013.01)

(58) Field of Classification Search

None

See application file for complete search history.

(56) References Cited

U.S. PATENT DOCUMENTS

| | | | | |
|---|---|---|---|---|
| 5,457,542 | A * | 10/1995 | Kim | H04N 5/9208 386/205 |
| 8,306,356 | B1 * | 11/2012 | Bever | G06K 9/723 382/275 |
| 8,446,427 | B2 * | 5/2013 | Uehori | G09G 5/346 345/619 |
| 8,645,856 | B1 * | 2/2014 | Burr | G06Q 30/0241 715/774 |
| 2007/0177466 | A1 * | 8/2007 | Ando | G11B 27/105 369/13.01 |
| 2007/0253680 | A1 * | 11/2007 | Mizote | H04N 5/44504 386/230 |
| 2011/0119578 | A1 * | 5/2011 | Schwartz | G06F 3/0485 715/702 |

FOREIGN PATENT DOCUMENTS

JP 2015192280 A 11/2015

* cited by examiner

*Primary Examiner* — David H Chu
(74) *Attorney, Agent, or Firm* — Holtz, Holtz & Volek PC

(57) ABSTRACT

According to one embodiment, a display apparatus includes a display unit configured to display an image; a character information acquisition unit configured to acquire character information which is associated with the image that is displayed on the display unit; a size acquisition unit configured to acquire a size of the image that is displayed on the display unit; and a display controller configured to determine a display mode of the character information acquired by the character information acquisition unit, in accordance with the size of the image which was acquired by the size acquisition unit, and to display characters and the image on the display unit.

6 Claims, 4 Drawing Sheets

DISPLAY APPARATUS INCLUDING DISPLAY UNIT WHICH DISPLAYS IMAGE, DISPLAY METHOD, AND STORAGE MEDIUM

CROSS-REFERENCE TO RELATED APPLICATIONS

This application is based upon and claims the benefit of priority from prior Japanese Patent Application No. 2016-124788, filed Jun. 23, 2016, the entire contents of which are incorporated herein by reference.

BACKGROUND OF THE INVENTION

1. Field of the Invention

The present invention relates to a display apparatus suitable for, for example, a projector in which the size of a displayed image is changed in accordance with an environment of installation, a display method, and a program.

2. Description of the Related Art

In Jpn. Pat. Appln. KOKAI Publication No. 2015-192280, there is proposed a technique which enables a user to easily visually recognize characters based on character information included in display screen information which is displayed on a display apparatus.

In the technique disclosed in the above-described patent document, such a configuration is adopted that a caption corresponding to an image, which is displayed on a display unit, is projected on an outside of a display apparatus that includes the display unit, for example, on an upper side of the display unit.

In the meantime, in a display apparatus which displays a general caption together with an image, the caption is displayed with the display position thereof being superimposed on a part of the screen. The ratio of the position range of the caption, which is occupied in the displayed image, is constant. If the display screen becomes smaller, the character size of the caption becomes smaller accordingly.

Thus, in an apparatus, such as a projector, which can greatly change the size of a projected (displayed) image by a projection distance and a zoom angle, if the size of the image is set to become smaller, the caption area in the image also becomes smaller. As a result, there is concern that the characters of the caption become difficult to read.

The present invention has been made in consideration of the above circumstance, and the object of the invention is to provide a display apparatus which can avoid, even when a displayed image is small, difficulty in reading characters which are simultaneously superimposed on the image and displayed, a display method, and a storage medium storing a program.

BRIEF SUMMARY OF THE INVENTION

In general, according to one embodiment, a display apparatus includes a display unit configured to display an image; a character information acquisition unit configured to acquire character information which is associated with the image that is displayed on the display unit; a size acquisition unit configured to acquire a size of the image that is displayed on the display unit; and a display controller configured to determine a display mode of the character information acquired by the character information acquisition unit, in accordance with the size of the image which was acquired by the size acquisition unit, and to display characters and the image on the display unit.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE PREFERRED EMBODIMENTS

Hereinafter, referring to the accompanying drawings, a description will be given of an embodiment in a case in which the invention is applied to a projector of a DLP (trademark) (Digital Light Processing) method.

Figure 1:
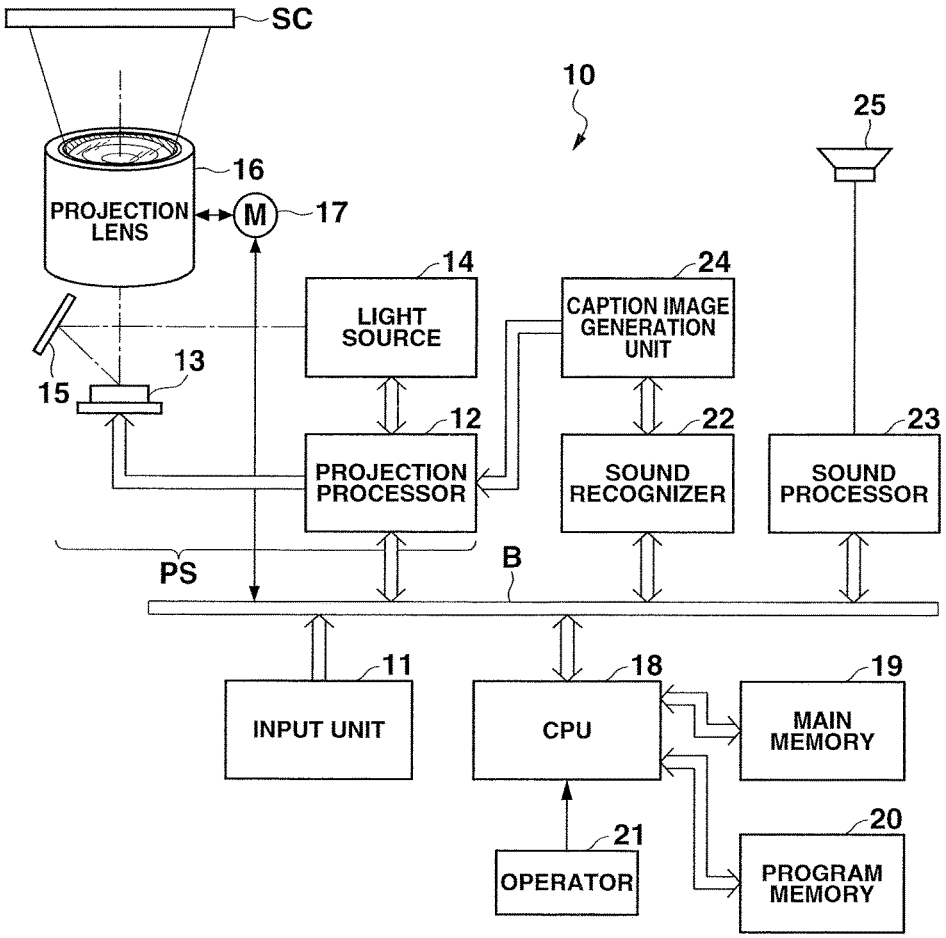
FIG. 1 is a block diagram illustrating a functional circuitry configuration of a projector according to an embodiment of the invention.

FIG. 1 is a view illustrating a schematic functional configuration of a projector 10 according to the present embodiment. An input unit 11 is composed of, for example, an HDMI (trademark) (High-Definition Multimedia Interface) terminal, a pin-jack (RCA) type video input terminal, a D-sub15 type RGB input terminal, a USB (Universal Serial Bus) terminal, and a memory card slot. An image signal and a sound signal are input to the input unit 11.

Image signals of various standards, which are input to the input unit 11, are digitized, where necessary, by the input unit 11, and are uniformized into image data of a predetermined format suited to projection, and the image data is sent to a projection processor 12 via a bus B.

The projection processor 12 drives a micromirror element 13 to effect display, by higher time-division drive obtained by multiplication of a frame rate following a predetermined format, for example, 60 [frames/second], a division number of a color component, and the number of display gradations, in accordance with image data that was sent.

The micromirror element 13 displays an image by operating, with an individual high-speed ON/OFF operation, each inclination angle of a plurality of micromirrors corresponding to, for example, WXGA (Wide eXtended Graphic Array) (lateral 1280 pixels×longitudinal 800 pixels) arranged in an array shape, thereby forming an optical image by reflection light.

On the other hand, a light source 14 cyclically and successively emits lights of a plurality of colors including R, G, B primary colors in a time-division manner. The lights from the light source 14 are total-reflected by a mirror 15, and applied to the micromirror element 13.

Then, the reflected light from the micromirror element 13 forms an optical image. The formed optical image passes through a projection lens 16 and is projected and displayed on a display unit such as a screen SC that is a projection target.

The projection lens 16 includes a zoom lens and a focus lens in an optical lens system. These lenses are individually driven by a lens motor 17, which is composed of a stepping motor, and a gear mechanism (not shown), and thereby the positions thereof on the projection optical axis are moved.

The projection processor 12, micromirror element 13, light source 14, mirror 15, projection lens 16 and lens motor 17 constitute a projection system PS.

A CPU 18 controls all operations of the above-described circuitry components. The CPU 18 is connected directly to a main memory 19 and a program memory 20. The main memory 19 is composed of, for example, an SRAM, and functions as a work memory of the CPU 18. The program memory 20 is composed of an electrically rewritable non-volatile memory, and stores operation programs to be executed by the CPU 18, various standardized data, and the like. The CPU 18 executes control operations in the projector 10 by using the main memory 19 and program memory 20.

The CPU 18 executes various projection operations in accordance with key operation signals from an operator 21.

This operator 21 includes a key operation unit which is provided in the main body of the projector 10, and an infrared reception unit which receives infrared from a remote controller (not shown) which is dedicated to this projector 10. The operator 21 outputs key operation signals based on keys, which the user operated by the key operator of the main body or by the remote controller, directly to the CPU 18.

The CPU 18 is further connected to a sound recognizer 22 and a sound processor 23 through the bus B.

The sound recognizer 22 executes a sound recognition process on a sound signal which is input to the input unit 11, generates text data corresponding to sound, and sends the text data to a caption image generation unit 24.

The caption image generation unit 24 incorporates a character buffer which stores the text data that is sent from the sound recognizer 22. The caption image generation unit 24 successively generates caption images which are to be scroll-displayed based on the text data stored in the character buffer, in accordance with a character font, a character size, a number of characters, and an inter-character spacing, which are instructed by the CPU 18 via the sound recognizer 22. The caption image generation unit 24 transmits the generated caption images to the projection processor 12, and causes the caption images to be superimposed on an image that is projected.

The sound processor 23 includes a sound source circuit such as a PCM sound source. The sound processor 23 converts a sound signal, which is delivered at a time of a projection operation, to an analog signal, and drives a speaker 25 to produce amplified sound, or to produce a beep sound or the like when necessary.

Next, the operation of the present embodiment will be described.

Incidentally, the operation to be described below is an operation which the CPU 18 of the projector 10 executes by developing the operation program or the like, which was read out from the program memory 20, into the main memory 19, as described above. The operation program or the like, which is stored in the program memory 20, includes not only a program which was stored in the program memory 20 at the time of factory shipment of the projector 10, but also a content, such as a version-up program, which the user installs after the user purchased the projector 10.

Figure 2:
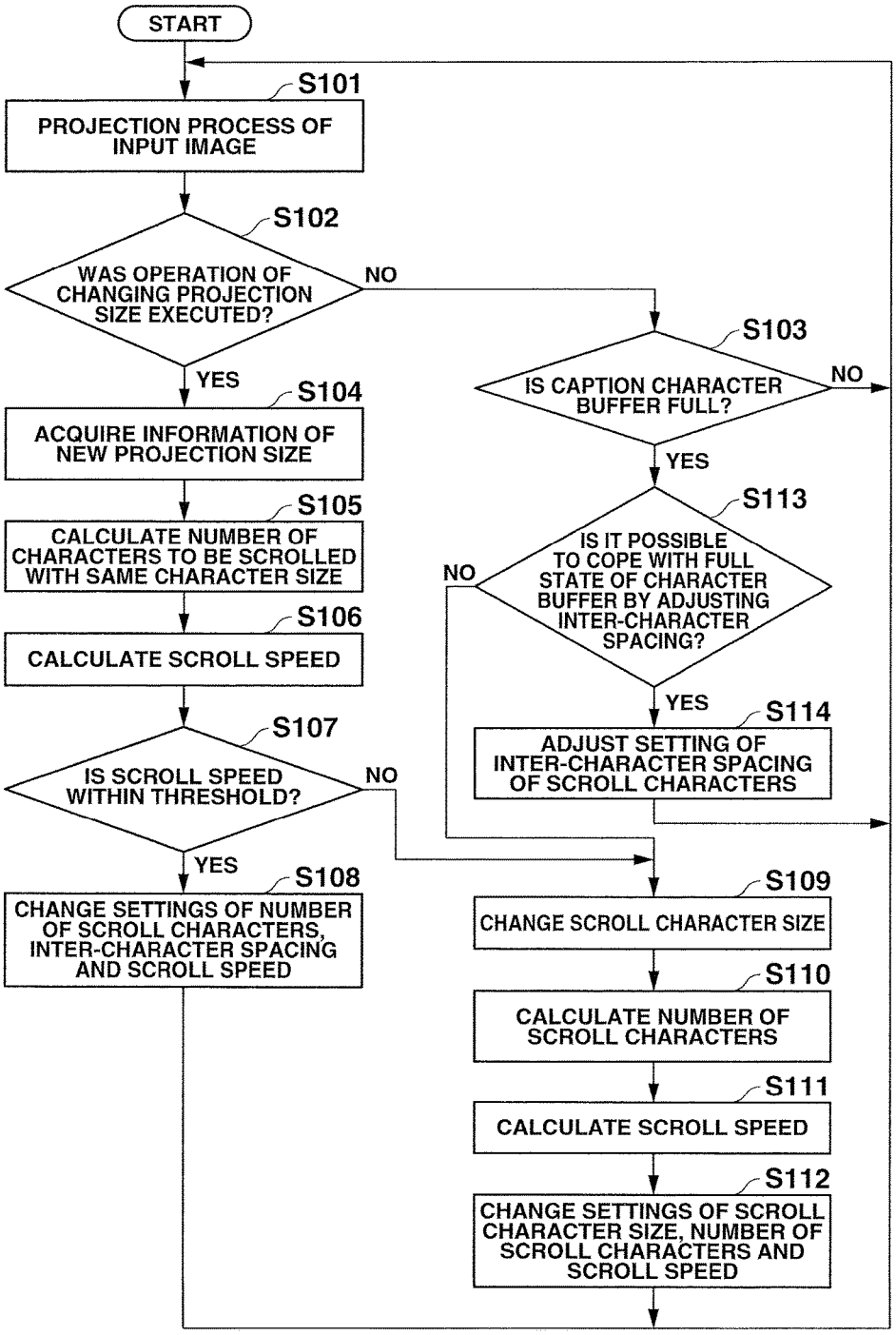
FIG. 2 is a flowchart illustrating the content of a process of changing caption projection in accordance with a change of projection size at a time of a projection operation according to the embodiment.

FIG. 2 is a flowchart illustrating a process content relating to a caption projection operation which the CPU 18 executes in parallel with a projection operation in a state in which a caption projection mode is set.

Figure 3:
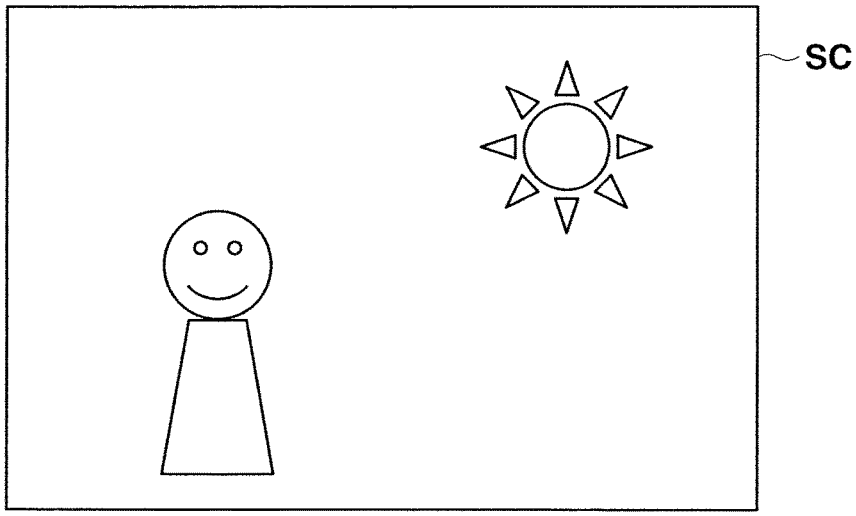
FIG. 3 is a view illustrating an example of a projection image according to the embodiment.

Incidentally, FIG. 3 illustrates, for a reference purpose, a projection image in a state in which the caption projection mode is not set. In FIG. 3, for example, it is assumed that an image of a weather forecast of a TV program is projected.

At the beginning of the process, the CPU 18 executes a projection process in accordance with various setting items which are set at the time point (step S101). In addition, the CPU 18 determines whether an operation for changing a projection size has been executed or not, to be more specific, whether the zoom lens or focus lens of the projection lens 16 has been operated or not (step S102).

Here, if it is determined that the operation for changing the projection size has been executed (No in step S102), the CPU 18 further determines whether the character buffer in the caption image generation unit 24 is full or not, by determining whether the amount of text data, which the character buffer in the caption image generation unit 24 stores, exceeds a preset amount or not (step S103).

If the CPU 18 determines that the amount of text data in the character buffer does not exceed the preset amount and the character buffer is not full (No in step S103), the CPU 18 returns to step S101 and executes the projection process.

In this manner, the CPU 18 repeatedly executes the process of steps S101 to S103, and stands by until the operation for changing the projection size is executed, or until the character buffer in the caption image generation unit 24 becomes full, while executing the projection operation.

If the CPU 18 determines that the operation for changing the projection size has been executed (Yes in step S102), the CPU 18 acquires information of a new projection size (step S104).

As described above, in this projector 10, the zoom lens and focus lens of the projection lens 16 are driven by the lens motor 17. The CPU 18 can recognize the projection view angle by the position of the driven zoom lens at the time point, and can recognize a distance to the projection surface by the position of the driven focus lens.

Accordingly, the CPU 18 can calculate the size of a projected image, from the projection view angle and the distance to the projection surface at the time point.

The CPU 18, which has acquired the information of the changed size of the projection image, calculates the number of characters which can be scroll-displayed in one screen in the projection image of the changed size, with the same character size of the caption which has been projected (step S105).

The CPU 18 calculates a scroll speed, from the calculated number of characters which can be scroll-displayed, and from the number of characters per unit time of the text data which is input to the character buffer in the caption image generation unit 24 from the sound recognizer 22 at the time point (step S106).

The CPU 18 determines whether it is possible to adapt to the change of the projection image size without changing the character size of projected characters, according to whether the calculated scroll speed is within a preset threshold that was preset as a limit value of the scroll speed (step S107).

If the CPU 18 determines that the calculated scroll speed is within the threshold and that it is possible to adapt to the change of the projection image size without changing the character size of projected characters (Yes in step S107), the CPU 18 changes the setting of at least one of the number of characters to be scroll-displayed, the inter-character spacing and the scroll speed, in the caption image generation unit 24 via the sound recognizer 22 (step S108), and then returns to the process from step S101.

Figure 4:
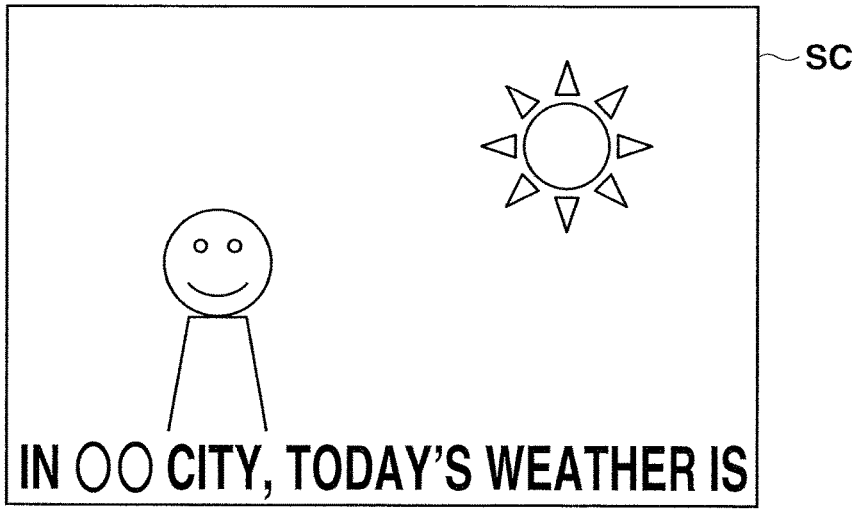
FIG. 4 is a view illustrating an example of a projection image according to the embodiment.

FIG. 4 is a view illustrating an example of a projection image before the image size is changed. FIG. 4 illustrates a state in which, in addition to the image shown in FIG. 3, caption characters "In ○○ city, today's weather is" are superimposed on a lower part of the screen, and are projected while being scrolled and played back.

Figure 5:
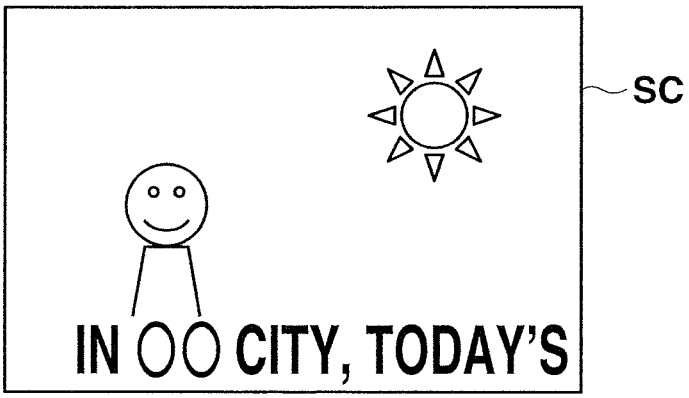
FIG. 5 is a view illustrating an example of a projection image according to the embodiment.

On the other hand, FIG. 5 is a view illustrating an example of a projection image after the image size is changed. Compared to the size of the projection images illustrated in FIG. 3 and FIG. 4, the size of the projection image illustrated in FIG. 5 is smaller. However, it is understood that the character size itself of the caption, which is superimposed in the image and projected, is unchanged. Accordingly, the number of characters, which can projected in one screen, becomes smaller. Thus, by increasing the scroll speed, the number of caption characters, which are projected and scrolled per unit time, can be made equal.

In addition, in the above-described step S107, if the CPU 18 determines that the calculated scroll speed exceeds the threshold and that it is not possible to adapt to the change of the projection image size without changing the character size of projected characters (No in step S107), the CPU 18 changes the character size of the projected caption by "1" size, in accordance with the new size of the projection image (step S109). Specifically, if the size of the projection image has become smaller after the change of size, the character size is decreased by "1" size.

Furthermore, the CPU 18 calculates, based on the changed character size, the number of characters which can be scroll-displayed in one screen (step S110). Then the CPU 18 calculates the scroll speed from the calculated number of characters which can be scroll-displayed, and from the number of characters per unit time of the text data which is recognized from the sound signal by the sound recognizer 22 at the time point (step S111).

The CPU 18 changes the settings of the size of characters to be scrolled, the number of characters to be scrolled, and the scroll speed, which were calculated in steps S109 to S111, in the caption image generation unit 24 via the sound recognizer 22 (step S112), and then returns to the process from step S101.

In addition, in the above-described step S103, if the CPU 18 determines that the amount of text data stored in the character buffer in the caption image generation unit 24 exceeds the preset amount and the character buffer is in the full state (Yes in step S103), the CPU 18 determines whether it is possible to cope with the full state of the character buffer by an adjustment operation of decreasing the inter-character spacing in the character image of the caption generated by the caption image generation unit 24, based on the information of the inter-character spacing at the time point (step S113).

Here, if the CPU 18 determines that there is an allowance in the inter-character spacing at the time point and that it is possible to cope with the full state of the character buffer by the adjustment operation of decreasing the inter-character spacing (Yes in step S113), the CPU 18 causes the caption image generation unit 24 to execute the adjustment operation of decreasing the inter-character spacing in the character image of the caption that is generated by the caption image generation unit 24, and changes the setting of the inter-character spacing (step S114), and then returns to the process from step S101.

In the above-described step S113, if the CPU 18 determines that there is no allowance in the inter-character spacing at the time point and that it is not possible to cope with the full state of the character buffer by only the adjustment operation of decreasing the inter-character spacing (No in step S113), the CPU 18 executes the process from the above-described step S109 in order to decrease, by "1" size, the character size of the caption to be projected.

As has been described above in detail, according to the present embodiment, even when the size of the image to be projected was changed and made smaller, it is possible to avoid the difficulty in reading characters which are simultaneously projected on the image, by preventing, as much as possible, the size of characters from becoming smaller.

Moreover, in the embodiment, in accordance with the size of the image to be projected, at least one of the scroll speed, the inter-character spacing and the number of characters, which are projected by being superimposed on the image that is projected by the projection system PS, is changed by the caption image generation unit 24. Therefore, it is possible to adapt to the change of the projection image size, even without changing the character image of the caption.

Additionally, in the embodiment, when the size of the projection image is greatly changed, the size of the character image of the caption is also changed accordingly. It is thus possible to avoid the character image becoming unnaturally larger in the entire image.

Additionally, the upper limit of the scroll speed of characters is preset as the threshold. When it is likely that the required scroll speed exceeds the threshold, the size of characters is changed to become smaller, and the scroll speed is limited. It is thus possible to maintain the character image projection of the caption at a proper scroll speed.

In the meantime, in the above embodiment, the case was described in which the invention is applied to a projector which projects an image onto a display unit such as a screen SC. However, the invention is not restricted to an apparatus which performs projection. It can be thought that the invention is applied to a playback application program which is used when a moving image is displayed, for example, in a case of changing the size of a window of an image which is displayed on a display that is a display unit of a personal computer, or in a case of transferring image data between a plurality of devices which have different display sizes and share images.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display apparatus comprising:

a display unit configured to display an image;

a character information acquisition unit configured to acquire character information which is associated with the image that is displayed on the display unit;

a size acquisition unit configured to acquire a size of the image that is displayed on the display unit; and a display controller configured to determine a display mode of the character information acquired by the character information acquisition unit, in accordance with the size of the image acquired by the size acquisition unit, and to display characters and the image on the display unit, wherein the display controller is configured to:

(i) decrease an inter-character spacing of the characters, if it is determined based on the character information that a number of the characters exceeds a number of characters that can be displayed on the display unit and that it is possible to adjust the inter-character spacing; and (ii) decrease a character size of the characters, if it is determined based on the character information that the number of the characters exceeds the number of characters that can be displayed on the display unit and that it is not possible to adjust the inter-character spacing.

2. The display apparatus of claim 1, wherein the display controller is further configured to acquire, as the size of the image, information on a new projection size in response to an operation for changing a projection size, to display the characters on the display unit by superimposing the characters on the image, and to change, in accordance with the size of the image, at least one of (i) a scroll speed of the characters which are superimposed on the image and displayed on the display unit, (ii) the inter-character spacing of the characters, and (iii) the number of the characters.

3. The display apparatus of claim 2, wherein the display controller is configured to change, in accordance with the size of the image, the character size of the characters which are superimposed on the image and displayed on the display unit.

4. The display apparatus of claim 2, wherein the display controller is configured to preset an upper limit of the scroll speed, and to determine the character size of the characters such that the character size of the characters becomes smaller, when the scroll speed, which is required, exceeds the upper limit.

5. A display method for a display apparatus comprising a display unit configured to display an image, the display method comprising:

acquiring character information which is associated with the image that is displayed on the display unit;

acquiring a size of the image that is displayed on the display unit; and performing display control to determine a display mode of the acquired character information, in accordance with the acquired size of the image, and to display characters and the image on the display unit, wherein the performing the display control comprises:

(i) decreasing an inter-character spacing of the characters, if it is determined based on the character information that a number of the characters exceeds a number of characters that can be displayed on the display unit and that it is possible to adjust the inter-character spacing; and (ii) decreasing a character size of the characters, if it is determined based on the character information that the number of the characters exceeds the number of characters that can be displayed on the display unit and that it is not possible to adjust the inter-character spacing.

6. A non-transitory computer-readable storage medium having a program stored thereon for causing a computer of an apparatus comprising a display unit configured to display an image to function as units comprising:

a character information acquisition unit configured to acquire character information which is associated with the image that is displayed on the display unit;

a size acquisition unit configured to acquire a size of the image that is displayed on the display unit; and a display controller configured to determine a display mode of the character information acquired by the character information acquisition unit, in accordance with the size of the image acquired by the size acquisition unit, and to display characters and the image on the display unit, wherein the display controller is configured to:

(i) decrease an inter-character spacing of the characters, if it is determined based on the character information that a number of the characters exceeds a number of characters that can be displayed on the display unit and that it is possible to adjust the inter-character spacing; and (ii) decrease a character size of the characters, if it is determined based on the character information that the number of the characters exceeds the number of characters that can be displayed on the display unit and that it is not possible to adjust the inter-character spacing.

* * * * *